US007017618B2

(12) United States Patent
Bassi et al.

(10) Patent No.: US 7,017,618 B2
(45) Date of Patent: Mar. 28, 2006

(54) SHED FORMING MECHANISM AND WEAVING LOOM EQUIPPED WITH SUCH A MECHANISM

(75) Inventors: Dario Bassi, Chaponnay (FR); Damien Bouchet, Chaponnay (FR)

(73) Assignee: Staubli Lyon, Chassieu (FR)

( * ) Notice: Subject to any disclaimer, the term of this patent is extended or adjusted under 35 U.S.C. 154(b) by 220 days.

(21) Appl. No.: 10/687,762

(22) Filed: Oct. 20, 2003

(65) Prior Publication Data

US 2004/0079433 A1 Apr. 29, 2004

(30) Foreign Application Priority Data

Oct. 25, 2002 (FR) ..... 02 13389

(51) Int. Cl.
*D03C 3/00* (2006.01)

(52) U.S. Cl. ..... 139/59

(58) Field of Classification Search ..... 139/455, 139/65, 59, 55.1, 317, 319
See application file for complete search history.

(56) References Cited

U.S. PATENT DOCUMENTS 3,747,647 A * 7/1973 Bergmann ..... 139/59
4,702,286 A * 10/1987 Palau et al. ..... 139/455
5,133,389 A 7/1992 Griffith
5,743,308 A 4/1998 Bassi et al.
5,839,481 A * 11/1998 Bassi et al. ..... 139/455

FOREIGN PATENT DOCUMENTS

| | | | |
|---|---|---|---|
| EP | 154823 | A1 * | 9/1985 |
| EP | 0779384 | | 6/1997 |
| EP | 0823501 | | 2/1998 |
| EP | 823501 | A1 * | 2/1998 |
| EP | 0930385 | | 7/1999 |
| EP | 930385 | A1 * | 7/1999 |
| EP | 1136603 | | 9/2001 |

* cited by examiner

*Primary Examiner*—John J. Calvert
*Assistant Examiner*—Andrew Sutton
(74) *Attorney, Agent, or Firm*—Dowell & Dowell, P.C.

(57) ABSTRACT

Hooks for controlling movement of heddle cords in a Jacquard weaving loom are each displaced by a knife, between a position of top dead center, wherein each hook may be immobilized by a selection device, and a position of bottom dead center. Each hook includes a body provided with a catch that engages a corresponding knife and a metal blade that is relatively movable with respect to portions of the body adjacent the catch and that interacts with the selection device to selectively retain the hook in the top dead position thereof.

16 Claims, 5 Drawing Sheets

SHED FORMING MECHANISM AND WEAVING LOOM EQUIPPED WITH SUCH A MECHANISM

BACKGROUND OF THE INVENTION

1. Field of the Invention

The present invention relates to a shed forming mechanism and to a weaving loom equipped with such a mechanism.

2. Brief Description of the Related Art

In a Jacquard type weaving loom, a shed forming mechanism selectively lifts heddles, each comprising an eye in which a warp yarn passes, this yarn being located, as a function of the position of a hook to which the upper end of the heddle is fixed, above or below a weft yarn displaced by the loom. Such a known mechanism, for example disclosed by EP-A-0 219 437, comprises, inter alia, mobile hooks each provided with a lateral catch capable of cooperating with knives animated by vertical reciprocating movements in phase opposition. Each mobile hook is provided with a curved end allowing it to be immobilized by cooperation of shapes with a retaining lever.

Each mobile hook is also provided with an elastic tongue in one piece with the hook and intended to control the displacement of the retaining lever. Such a tongue is subjected to repeated, relatively intense efforts likely to induce permanent deformation by creeping, and even rupture thereof. In that case, the shed obtained presents "faults".

It is a particular object of the present invention to overcome these drawbacks by proposing a shed forming mechanism of which the mobile hooks are robust and dimensioned precisely, this ensuring reliable operation of the loom, while they are compact in height, i.e. parallel to their direction of displacement. This makes it possible to create a compact mechanism, hence a saving of space and improved economic performances.

SUMMARY OF THE INVENTION

To that end, the invention relates to a shed forming mechanism on a weaving loom of a Jacquard type, this mechanism comprising mobile hooks, each displaced by a knife, between a position of top dead center, wherein each hook may be immobilized by a selection device, and a position of bottom dead center, and wherein each hook includes a body provided with a catch abuts with the afore-mentioned knife. This mechanism is characterized in that each hook further comprises a metal blade intended to interact with the selection device and fixed on the body in such a manner that the blade is relatively movable with respect to portions of the body adjacent the area of the catch.

Thanks to the invention, the two-part nature of the mobile hooks, of which the body is advantageously made of synthetic material, makes it possible to benefit from the robustness of the body for the mechanical link between the hook and the knife, while the geometry of the metal blade is defined with high precision, this rendering the interactions between the mobile hook and the selection device highly reliable. As the metal blade is fixed on the body in the lower part when the hook is in configuration of operation of the mechanism, the flexibility of the blade, over substantially the whole of its height, may be used for the transverse displacement of its part more particularly intended to come into engagement with a corresponding part of the selection device. The fact that a relative clearance is possible between the blade and the body of the hook may come from the suppleness of the blade and/or from that of the body.

According to advantageous, but non-obligatory aspects of the invention, this mechanism incorporates one or more of the characteristics of the dependent Claims.

In particular, the electromagnet of the selection device may be molded in one of the sides of a box for receiving and for guiding the mobile hook in translation. Such molding induces a precise positioning of the electromagnet with respect to the other functional parts of the device, such as the pins of the retaining levers, the stops and the bearings of these levers, as well as grooves for guiding the mobile hooks. Due to this high precision, the amplitudes of the movements of the mobile parts may be reduced, particularly concerning the oscillation of the retaining levers and the bending of the blades of the mobile hooks. This also contributes to the compactness of the mechanism.

The invention also relates to a weaving loom equipped with a shed forming mechanism as described hereinabove.

BRIEF DESCRIPTION OF THE DRAWINGS

The invention will be more readily understood and other advantages thereof will appear more clearly on reading the following description of three forms of embodiment of a shed forming mechanism in accordance with its principle, given solely by way of example and made with reference to the accompanying drawings, in which.

DESCRIPTION OF PREFERRED EMBODIMENTS

Figure 1:
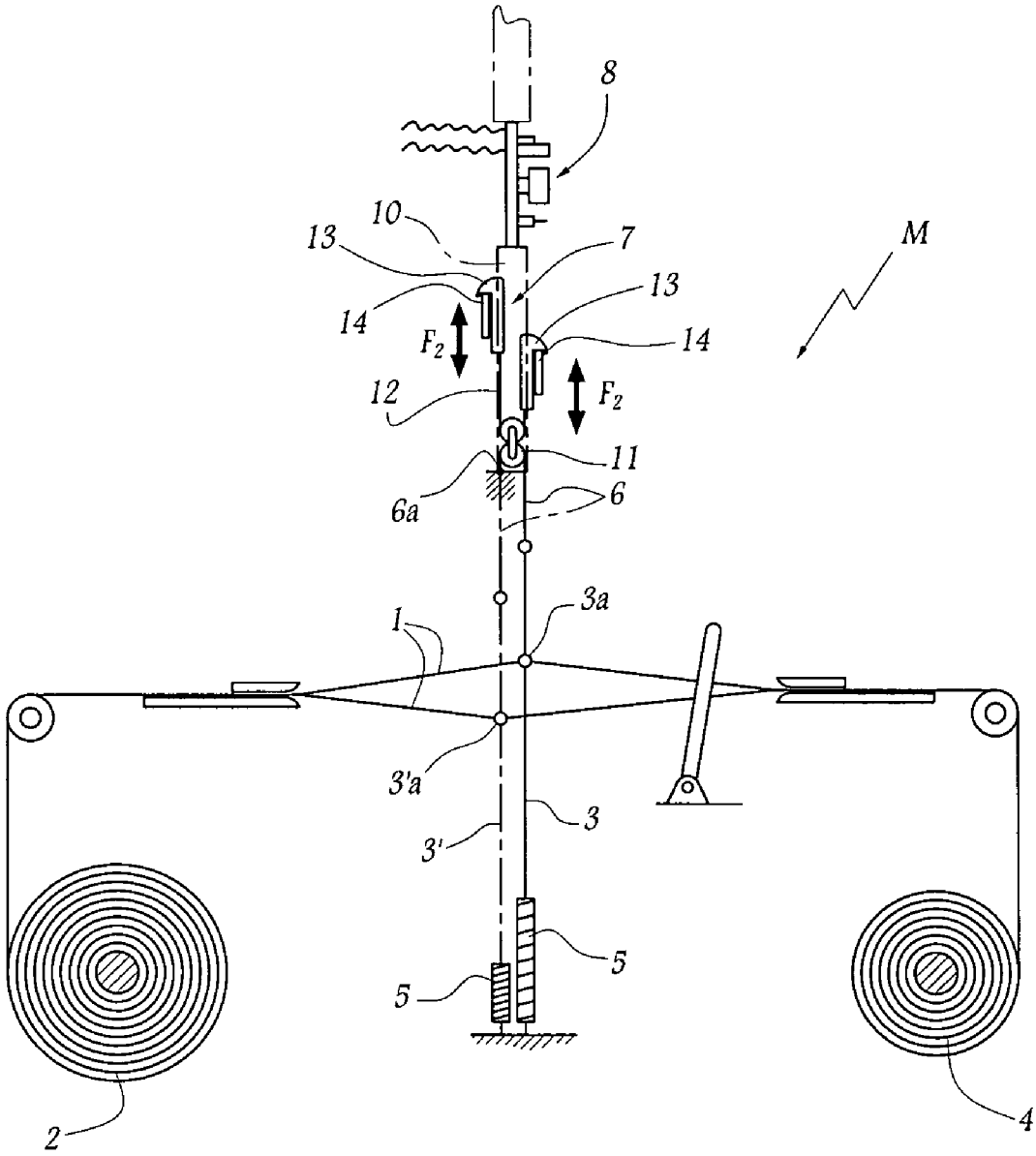
FIG. 1 schematically shows a weaving loom of Jacquard type incorporating the invention.

Referring now to the drawings, FIG. 1 shows a weaving loom M in which a lap of warp yarns 1 comes from a beam 2. Each warp yarn 1 passes in the eye 3*a* of a heddle 3 intended to open the shed to allow the passage of a pick with a view to constituting the fabric which is wound on a reel 4. Only two heddles 3 and 3' are shown in FIG. 1, heddle 3 being in upper position, while heddle 3' is in lower position. The lower end of each heddle is connected to the frame of the weaving loom by an extension spring 5, while its upper end is fast with harness cords 6.

A shed forming mechanism 7 associated with an electronic control unit 8 makes it possible to lift the harness cords 6 more or less against a return effort exerted by the springs 5. As shown solely for the harness cord associated with the heddle 3, each harness cord has one end 6*a* fast with a box 10 of the mechanism 7, this harness cord passing in a pulley block 11 suspended from a cord 12 of which the two ends are respectively fast with two mobile hooks 13 intended to be selectively lifted by knives 14 animated by a vertical oscillatory movement in phase opposition, as represented by arrows $F_2$.

Only a part of the elements constituting the shed forming mechanism has been shown in FIG. 1 in order to render the drawing clearer.

Figures 2, 2A, 2B:
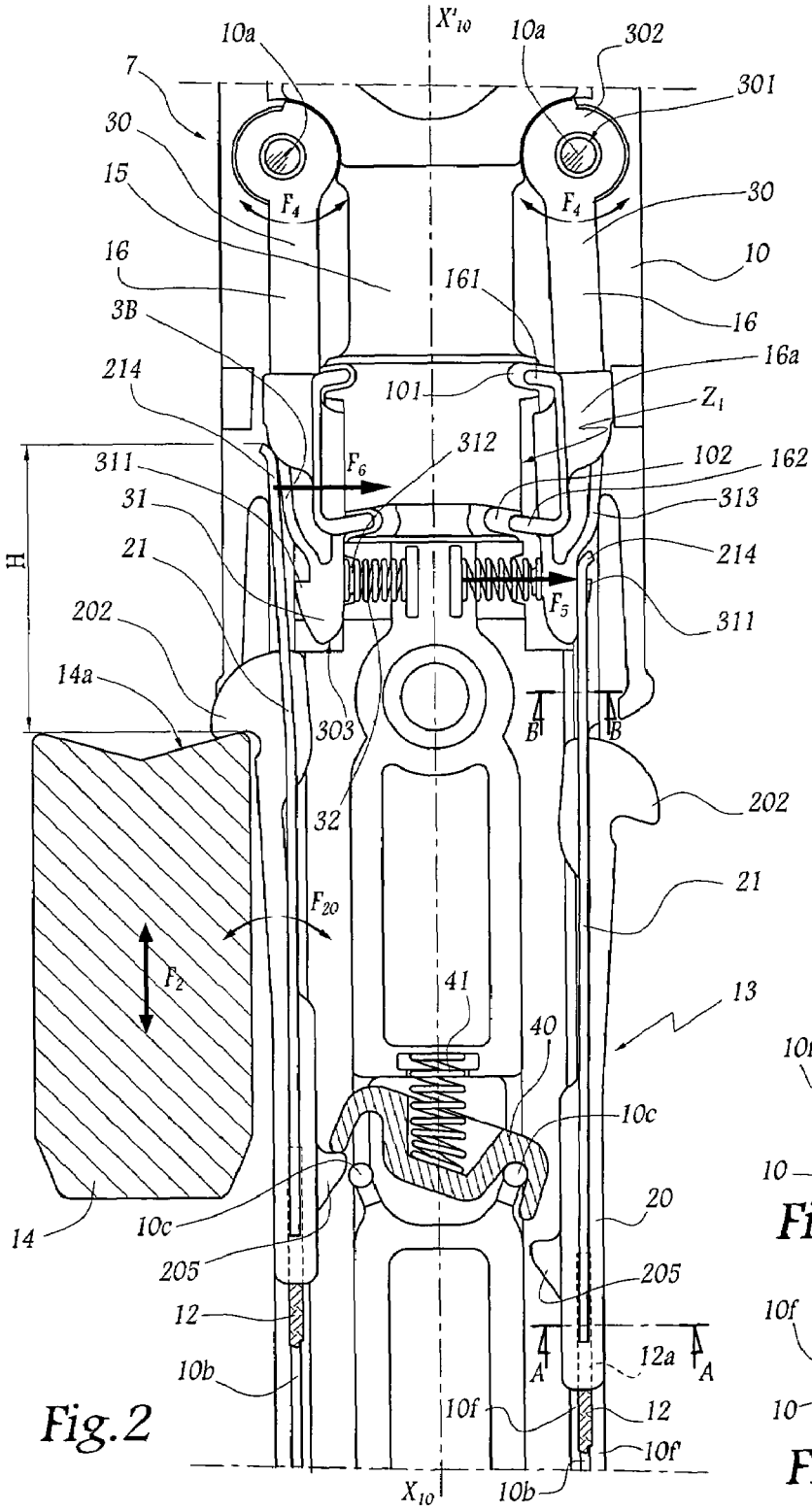
FIG. 2 is a longitudinal section on a larger scale of the shed forming mechanism of the loom of FIG. 1.
FIGS. 2A and 2B are partial sections respectively along lines A—A and B—B in FIG. 2.
Figure 4:
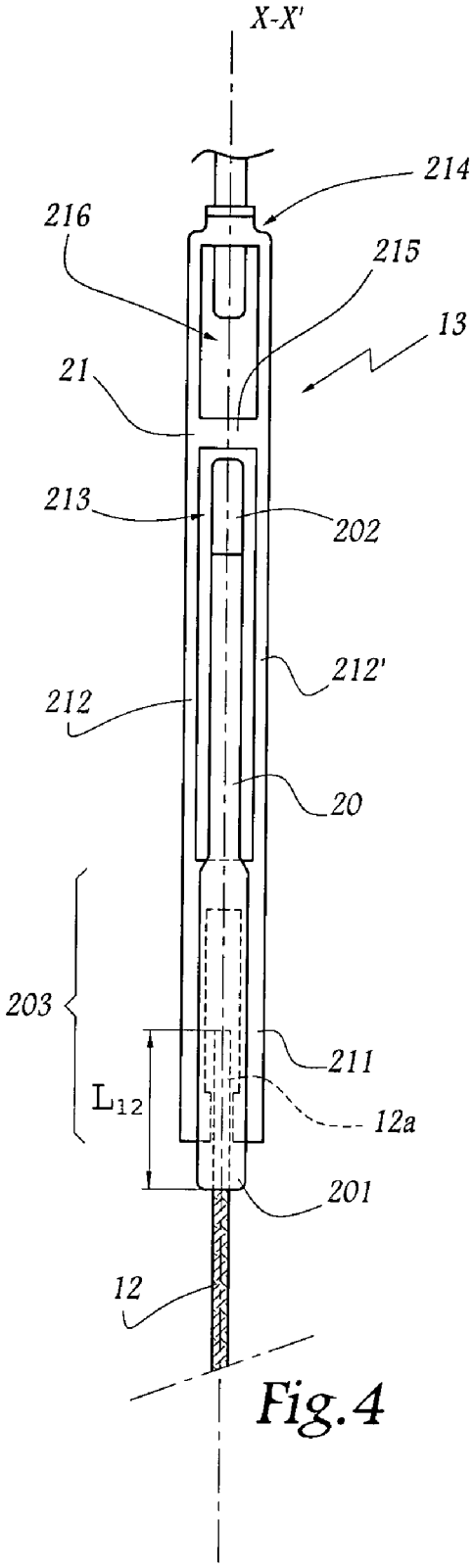
FIG. 4 is a view in the direction of arrow IV in FIG. 3.
Figure 3:
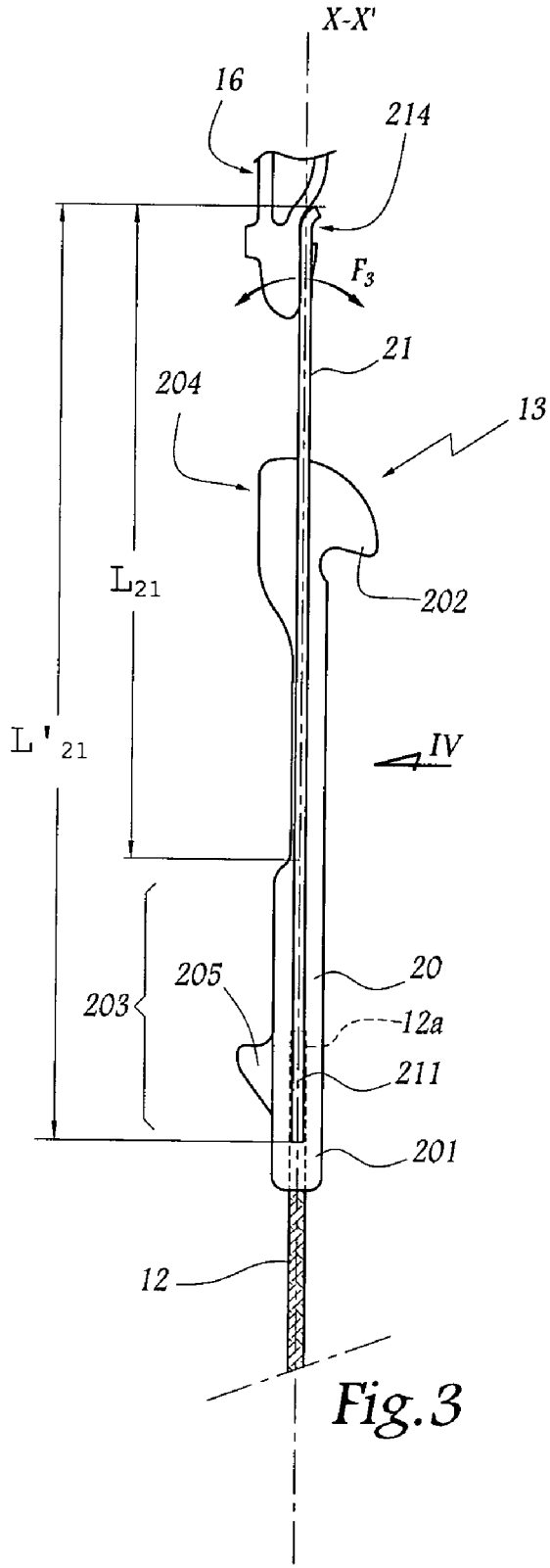
FIG. 3 is a view on a larger scale of a mobile hook and a part of a retaining lever of the mechanism of FIG. 2.

As is more particularly visible in FIGS. 2 to 4, each hook 13 is formed by a body 20 of plastic material, in the lower end 201 of which is molded an end 12*a* of the cord 12.

The body 20 forms a single catch 202 which extends laterally with respect to a principal longitudinal axis X–X' of the body 20. This catch 202 is intended to come into abutment on the upper surface 14*a* of a knife 14. The hook 13 may thus be regularly lifted by a single knife 14.

Taking into account its constituent material, the body 20 presents a certain suppleness, allowing it to adapt itself to a possible defect of position or of parallelism of the respective paths of this body and of the knife 14 associated therewith. This possibility of elastic deformation of the body 20 is represented by the double arrow $F_{20}$ in FIG. 2. In practice, the suppleness of the body 20 makes it possible to obtain a self-positioning of the catch 202 on the knife 14.

The hook 13 also comprises a metallic blade 21 partially molded in the body 20. In practice, the blade 21 comprises a part 211 molded in a zone 203 of the body 20, located near its lower end 201, i.e. below the part 204 of the body 20 from which the catch 202 extends laterally.

The part 211 is open downwardly, this allowing the passage of the end 12*a* of the cord 12 which may therefore be molded in the body 20 over a relatively great length $L_{12}$.

The blade 21 extends over a length $L_{21}$, above its part 211, this length being relatively great with respect to the total length $L'_{21}$ of the blade 21.

The blade 21 comprises two lateral uprights 212 and 212' defining therebetween a window 213 in which is housed the major part of the body 20.

The uprights 212 and 212' extend beyond the window 213 as far as a curved end 214. The uprights 212 and 212' are connected by a crosspiece 215 which separates the window 213 from an opening 216 made between parts 212, 212', 214 and 215 of the blade 21.

Taking into account how they are mounted, the elements 20 and 21 are secured in the lower part of the hook 13, while that part of the blade 21 which extends over the length $L_{21}$ above the zone 203 of the body 20, is capable of lateral movements, as represented by the double arrow $F_3$ in FIG. 3. These lateral movements $F_3$ correspond, in fact, to a relative clearance of the blade 21 with respect to the body 20.

The mechanism 7 also comprises an electromagnet 15 molded in a part of the box 10. This molding ensures a precise positioning of the electromagnet 15 with respect to the box 10 and to the elements that it supports or guides.

The box 10 comprises two fixed pins 10*a* on which are pivotally mounted two retaining levers 16 intended to cooperate respectively with the two mobile hooks 13 connected to the two ends of the same cord 12.

Each lever 16 comprises a metallic armature 30 provided with a cylindrical bore 301 of circular cross-section adapted to the outer diameter of a pin 10*a*, with the result that the armature 30 may be mounted about a pin 10*a* with the possibility of pivoting, as represented by the double arrows $F_4$ in FIG. 2. The bore 301 of each armature 30 is made in an end 302 of this armature.

At its opposite end 303, the armature 30 is in a body 31 made of an material, such as synthetic material and, more specifically, a material. The body 31 forms a catch 311 for retaining a mobile hook 13 in the vicinity of its position of top dead center. The body 31 is also provided with a heel 312 for centering with respect to a spring 32 exerting on the body 31 an effort or force $F_5$ tending to cause the lever 16 to pivot towards the outside of the box 10. This effort tends to cause the catch 311 to penetrate in the opening 216 of the blade 21 of an adjacent mobile hook, which makes it possible to retain such a mobile hook in an upper position.

The metallic armature 30 of a lever 16 makes it possible to control its pivoting thanks to the electromagnet 15, a lever 16 being able to be displaced by the curved end 214 of a blade 21 and possibly maintained in position against the effort $F_5$ when the electromagnet 15 is activated.

The body 31 allows an efficient interaction, without metal/metal contact, of a retaining lever 16 with a mobile hook 13.

The levers 16 are each provided with a deflector 161 projecting with respect to their principal part 16*a* in the direction of the median axis $X_{10}$–$X'_{10}$ of the box 10, between its pivot axis 10*a* and a zone $Z_1$ in which the armature 30 can come into abutment against the electromagnet 15. A second deflector 162 is provided between the zone $Z_1$ and the adjacent hook 13. The deflectors 161 and 162 are mobile with the lever 16, inside grooves 101 and 102 made in the body 10, which allows them to isolate the zone $Z_1$ which thus forms a closed chamber protected against pollution, particularly the flock likely to be transported by a hook 13.

Taking into account the positioning of the pins 10*a* on the box 10 and the geometry of the levers 16, these levers extend solely downwardly from these fixed pins, which gives the mechanism 7 an improved compactness with respect to the mechanisms in which the lever extends on either side of its pivot axis, as described for example in EP-A-0 219 437.

Furthermore, the uprights 212 and 212' of the blade 21 of a hook 13 slide in grooves 10*b* made over the height of the box 10, as shown in FIG. 2 where the cords 12 have been shown partially so that the grooves 10*b* are visible. In this way, guiding of a lever 13 with respect to the box 10 is effected precisely and with minimum wear. As is shown in FIGS. 2A and 2B, each groove 10*b* of the box 10 is defined by two ribs 10*f* and 10*f'* between which it extends, this allowing an efficient guiding of the upright 212 or 212' that it receives. Each rib presents this shape of the bottom of the box 10 approximately as far as the location of the upper convex part of the catch 202 to the right in FIG. 2 where the rib 10*f'* is eliminated, while the rib 10*f* extends upwardly. The elimination of the outer edge 10*f'* of the groove, i.e. the fact that it is open towards the outside of the box in the vicinity of the retaining lever 16, allows the outward clearance of the blade 21, in the direction of arrow $F_7$ in FIG. 2B, when the blade 21 comes into abutment against the adjacent lever 16, as shown to the left in FIG. 2, in order to exert an effort of levelling $F_6$.

In practice, the bending of the blade 21 takes place at that part of the box 10 where the groove 10*b* has no outer edge, this part extending over a height H, between the position of the top of the catch 202 to the right in FIG. 2 and the zone of interaction between the blade 21 and the lever 16 during levelling.

According to a variant of the invention (not shown), it is possible for the rib 10*f'* which forms the outer edge of the groove 10*b* not to be eliminated over the height H but to deviate from the rib 10*f* in order to leave the blade 21 a sufficient clearance space.

In the form of embodiment shown and in the aforementioned variant, the widening or opening of the groove

10*b* towards the outside in the vicinity of the elements 15 and 16 aims at allowing the bending of the blade 21 in this zone.

In accordance with the technical teaching of FR-A-2 752 246, a stop 40, elastically urged by a spring 41, is mounted between the paths of slide or movement of two mobile hooks 13, in abutment on studs 10*c* of the box 10. This elastic stop 40 is intended to cooperate with a heel 205 made in the vicinity of the end 201 of each body 20. Taking into account the respective positioning of the elements 205 and 40, this interaction takes place when each mobile hook 13 arrives in the vicinity of its position of top dead center. This arrangement makes it possible to essentially overcome the forces of inertia and of friction of the mobile hooks, this facilitating reversal of movement and allowing the dimensioning of the harness and the mechanical drive elements, such as the knives 14 or the return springs 5, to be optimised.

The curved end 214 of the blade 21 is also dimensioned so that it can come into abutment and exert an effort $F_6$ against a ramp 313 formed by the body 31 of each lever 16. This momentary abutment of a hook 13 on a lever 16 allows the lever 16 to be levelled, i.e. made to abut on the electromagnet 15, with elastic pre-loading due to the bending of the blade 21 which performs the function of the elastic tongue described in EP-A-0 219 437. The blade 21 therefore performs a function of levelling.

Figure 5:
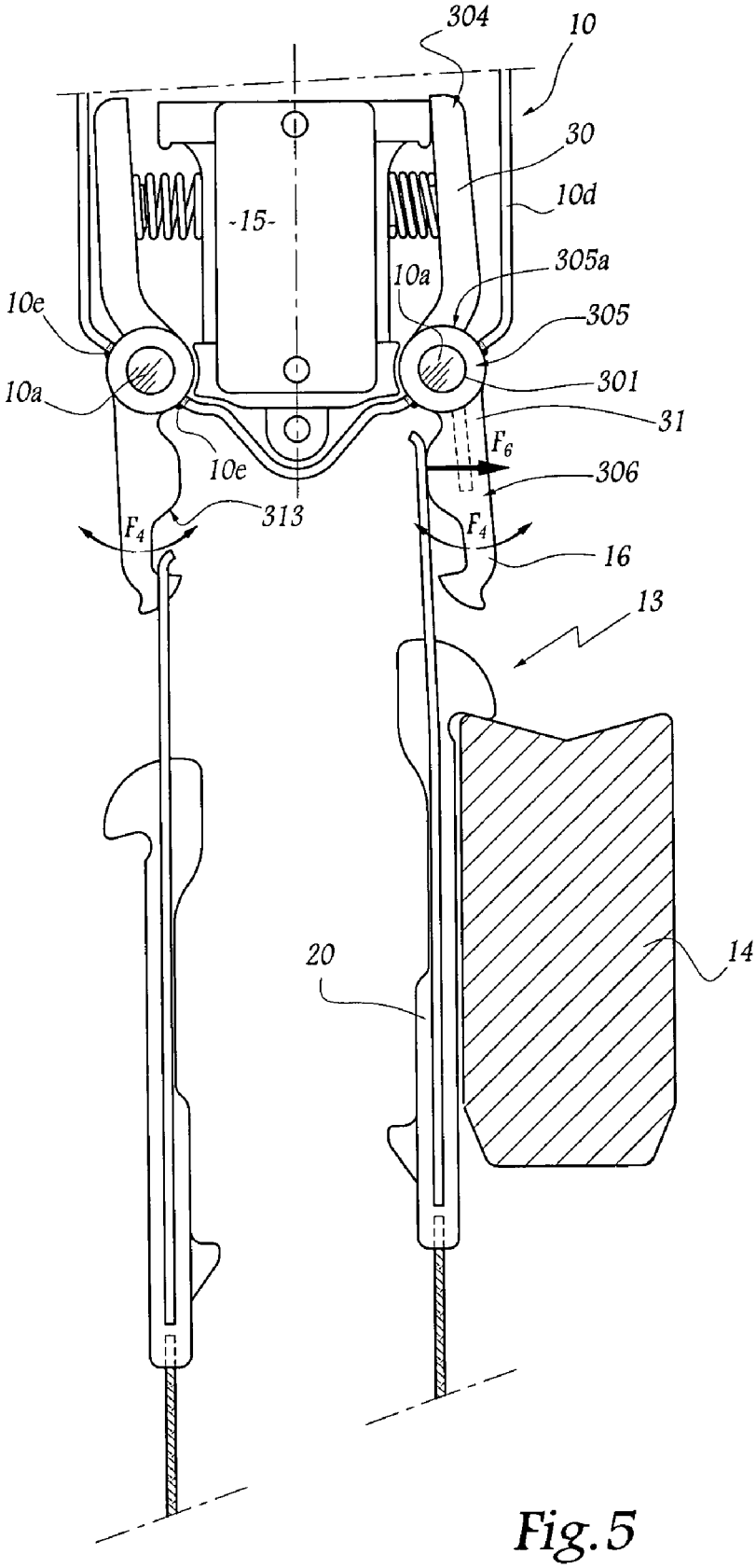
FIG. 5 is a view similar to FIG. 2 for a mechanism in accordance with a second form of embodiment of the invention.

In the second form of embodiment of the invention shown in FIG. 5, elements similar to those of the first embodiment bear identical references. As previously, knives 14 make it possible selectively to displace mobile hooks 13 each comprising a body 20 made of synthetic material and an elastic metal blade 21 which essentially extends above the zone where it is fixed to this body. Retaining levers 16 are associated with an electromagnet 15.

In this embodiment, the levers 16 are mounted to pivot about pins 10*a* fixed with respect to a box 10. The technical teaching of EP-A-0 577 524 is applied here, insofar as the box 10 comprises partitions 10*d* making it possible to isolate the electromagnet 15 from the ambient atmosphere. Each lever 16 is mounted to pivot on a corresponding pin 10*a*, as represented by the double arrow $F_4$ and comprises an armature 30 which extends on either side of the pin 10*a* on which it is mounted. More precisely, each armature 30 comprises a first arm 304 which extends upwardly from a central part 305 in which is made a circular bore 301 for receiving the pin 10*a*. The arm 304 is intended to interact with the electromagnet 15 during its activation. The armature 30 also comprises an arm 306 which extends opposite the arm 304 with respect to the part 305. This arm 306 is molded in a body 31 made of plastic material which forms a catch 311 intended to interact with an opening 216 of the blade 21 of a hook 13. The body 31 also forms a ramp 313 for levelling the position of the lever 16 used during an interaction with the curved upper end 214 of a blade 21. The blade 21 in that case exerts on the lever 16 an effort $F_6$ of displacement of the armature 30 towards the electromagnet 15.

In order to isolate the electromagnet 15 efficiently, the partitions 10*d* of the box 10 are provided with O-rings 10*e* disposed in the vicinity of the outer surface 305*a*, cylindrical with circular base, of the part 305. In this way, independently of the orientation of a lever 16 about the axis 10*a*, a satisfactory seal can be ensured.

In a variant embodiment, the partitions 10*d* may be provided with reduced clearance with respect to the surface 305*a*, the seals 10*e* in that case being able to be eliminated, as the ends of the partitions 10*d* then constitute means for seal against dust.

Figure 6:
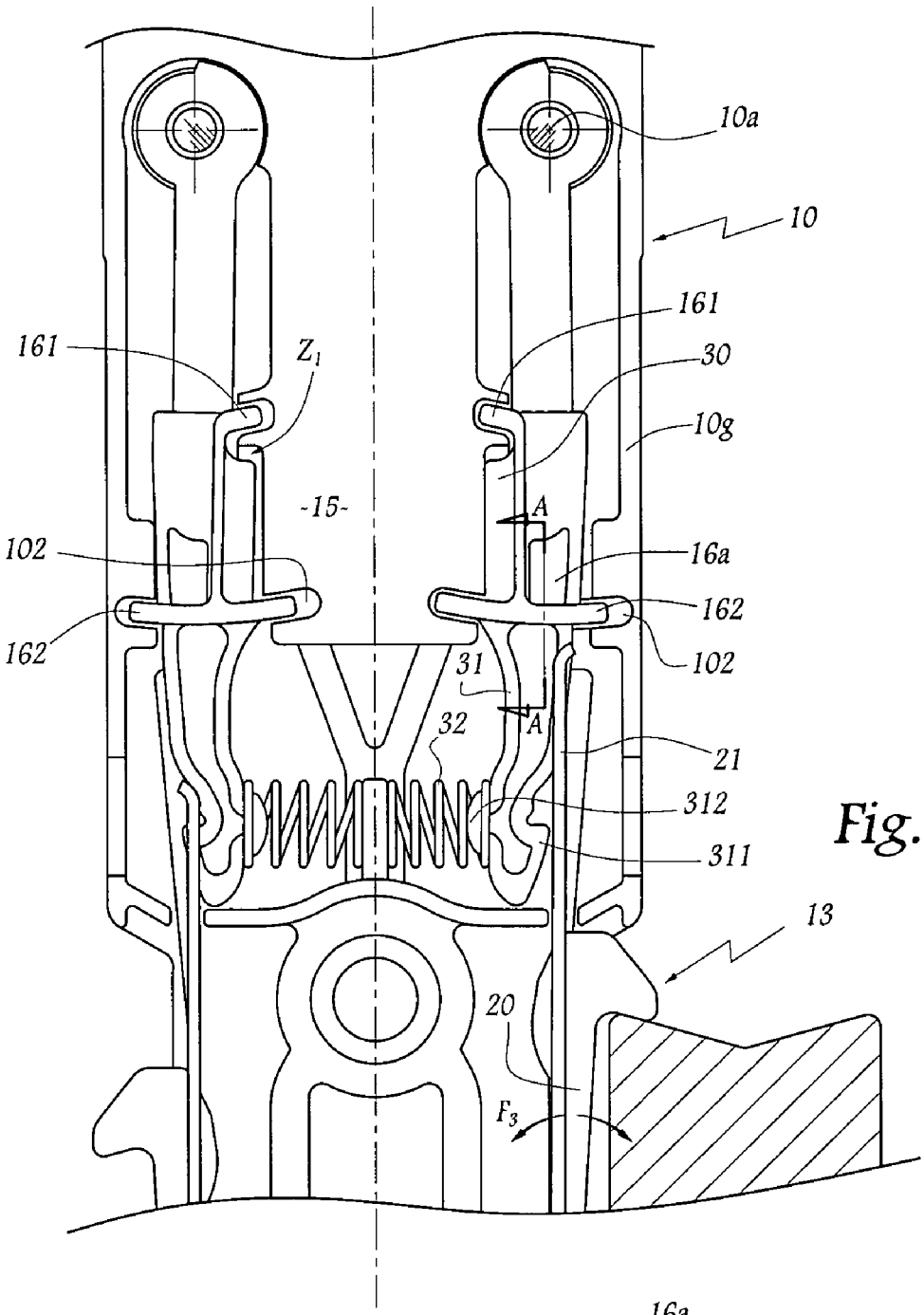
FIG. 6 is a partial longitudinal section through a mechanism in accordance with a third form of embodiment.

In the third form of embodiment shown in FIG. 6, elements similar to those of the first embodiment bear identical references. As previously, hooks 13 each comprise a body 20 made of plastic material as well as a metal blade 21, these elements being molded in one another in the lower part of the body 20. A movement of relative clearance $F_3$ is possible between the body 20 and the blade 21 of each hook. The blade 21 of each hook may be retained in position by a catch 311 formed by a body 31 of a retaining lever 16 mounted to pivot about a pin 10*a* formed by a box 10.

Each lever 16 comprises a metal armature 30 that interacts with an electromagnet 15 at a zone $Z_1$ in which the armature 30 may come into abutment against the electromagnet 15 against an elastic effort or force exerted by a spring 32 centered on a heel 312 of the body 31.

As in the first form of embodiment, a deflector 161 is provided on each lever 16, between the armature 30 and the pin 10*a* while a second deflector 162 is provided between the armature 30 and that part of the body 31 intended to interact with the blade 21 of a hook 13. The deflector 162 of this third embodiment may move inside a groove 102 made in the box 10 between the positions respectively shown to the left and to the right of FIG. 6. This deflector 162 projects with respect to the principal part 16*a* of the lever 16 both in the direction of the median axis $X_{10}$–$X'_0$ of the box 10 and opposed thereto, with the result that the circulation of flock or of dust is prevented both between the lever 16 and the electromagnet 15 and between the lever 16 and the outer web 10*g* of the box 10.

Figure 6A:
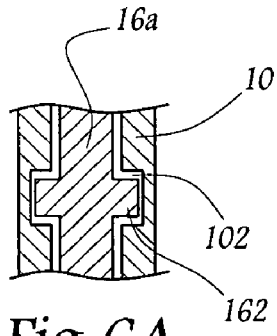
FIG. 6A is a partial section along line A—A in FIG. 6.

In addition, and as is more particularly visible in FIG. 6A, the deflector 162 also projects perpendicularly to the plane of FIG. 6 with respect to the principal part 16*a* of the lever 16, this also avoiding pollution rising in the direction of the armature 30.

Whatever the form of embodiment in question, the elastic blade 21 efficiently performs the functions of selection and of levelling, while it is not in contact with the adjacent knife 14, the function of direct interaction with the knife devolving on the catch 202 of the body 20. In the same way, the body 20, through which the effort of traction exerted by the knife 14 transits, does not enter directly into contact with the selection device which comprises the elements 15 and 16.

The characteristics of the different forms of embodiment described may be combined within the framework of the present invention.

The invention relates to two-position shed forming mechanisms used for weaving so-called "flat" fabrics, unlike three-position mechanisms used for carpets and velvets. However, the invention can be used within the scope of associating two-position mechanisms allowing a three- or four-position shed to be obtained, as described for example in EP-B-0 399 930 or FR-B-2 715 666.

What is claimed is:

1. A shed forming mechanism on a weaving loom of Jacquard type, said mechanism including mobile hooks, each displaced by a knife, between a position of top dead center, wherein each hook may be retained by a selection device, and a position of bottom dead center, each mobile hook comprising a body provided with a catch engageable by a knife, each hook further comprises a metal blade that has an upper portion that extends above said catch and interacts with a selection device and a lower portion that is secured to said body below said catch in such a manner that said upper portion of said metal blade extends toward said selection devise and is relative movable with respect to said catch.

2. The mechanism of claim 1, wherein said body is made of synthetic material and said lower portion of said blade being molded to said body.

3. The mechanism of claim 1, wherein said body is formed so as to be supple.

4. The mechanism of claim 1, wherein said upper portion of said metal blade includes an engaging portion for engaging a mobile lever of said selection device to urge said mobile lever into abutment on an electromagnet that controls pivoting of said mobile lever.

5. The mechanism of claim 1, wherein said metal blade is provided with a window for receiving at least a part of said body therein.

6. The mechanism of claim 1, wherein said metal blade is provided with at least one opening for engagement of a selection catch of said selection device.

7. The mechanism of claim 1, wherein said metal blade includes two sides adapted to slide in grooves in a box for receiving and guiding said mobile hook in translation.

8. The mechanism of claim 7, wherein said grooves widen outwardly towards an outside of said box in a vicinity of said selection device such that said metal blade may flex relative to said selection device.

9. The mechanism of claim 1, in which said retaining device includes at least one retaining lever, wherein said at least one retaining lever includes a metal armature adapted to interact with an electromagnet for controlling a position of said at least one retaining lever, and a non-magnetic part forming an element in relief on said armature that cooperatively engages with said upper portion of said metal blade.

10. The mechanism of claim 9, wherein said at least one retaining lever is mounted to pivot about a fixed pin from which it extends substantially downwardly toward said upper portion of said metal blade.

11. The mechanism of claim 9, wherein said at least one retaining lever is provided with at least one deflector that defines a cover of a chamber in which said armature and said electromagnet are positioned.

12. The mechanism of claim 11, wherein said said at least one deflector extends on either side of a principal part of said at least one retaining lever.

13. The mechanism of claim 11, wherein said at least one deflector is positioned between said chamber and said hook adjacent to said at least one retaining lever.

14. The mechanism of claim 9, wherein said at least one retaining lever is mounted to pivot about a pin fixed with respect to a box isolating said electromagnet from ambient atmosphere, said at least one retaining lever extending both inside and outside said box, and sealing means provided between said box and a circular part of said at least one retaining lever substantially centered on said pin.

15. The mechanism of claim 1, in which said selection device comprises an electromagnet, and said electromagnet being molded in a box for separating and guiding said mobile hooks.

16. A weaving loom comprising; a shed forming mechanism for controlling heddle cords, said shed forming mechanism including mobile hooks, each displaced by a knife, between a position of top dead center, wherein each hook may be retained by a selection device, and a position of bottom dead center, each mobile hook comprising a body provided with a catch engageable by a knife, each hook further comprises a metal blade that has an upper portion that extends above said catch and interacts with a selection device and a lower portion that is secured to said body below said catch in such a manner that said upper portion of said metal blade extends toward said selection devise and is relative movable with respect to said catch.

* * * * *